United States Patent [19]

Bunch, Jr.

[11] Patent Number: 5,004,452

[45] Date of Patent: Apr. 2, 1991

[54] CONTINUOUS FORM STATIONERY FOLDING MACHINE WITH PERFORATION ALIGNMENT APPARATUS

[76] Inventor: Earnest B. Bunch, Jr., 9619 N. 21st Dr., Phoenix, Ariz. 85021

[21] Appl. No.: 336,079

[22] Filed: Apr. 11, 1989

[51] Int. Cl.[5] ..... B65H 45/20; B65H 45/105

[52] U.S. Cl. ..... 493/414; 493/411

[58] Field of Search ..... 493/411–415, 493/417

[56] References Cited

U.S. PATENT DOCUMENTS

| | | | |
|---|---|---|---|
| 4,522,619 | 6/1985 | Bunch, Jr. | 493/415 |
| 4,618,340 | 10/1986 | Meschi | 493/412 |
| 4,650,447 | 3/1987 | Meschi | 493/412 |

*Primary Examiner*—Frederick R. Schmidt
*Assistant Examiner*—Jack Lavinder
*Attorney, Agent, or Firm*—Tod R. Nissle

[57] ABSTRACT

An improved continuous form stationery folding machine. The machine includes a dispensing roller which directs a continuous strip of paper into a mechanism which distributes successive lines of weakening formed in the paper in substantially opposite directions. The machine also includes mechanisms for creasing the distributed paper along lines of weakening to produce continuous form stationery. A system of timing marks in the machine enables lines of weakening to be properly positioned in the machine with respect to the timing marks and the mechanism for distributing successive lines of weakening in substantially opposite directions.

1 Claim, 9 Drawing Sheets

CHUTE POSITION (SIDE VIEW)
SPIRAL POSITION (TOP VIEW)
BEATER POSITION (SIDE VIEW)

19A
19
87
104
42A
41A 19
19A
108
M
87
42A
104
41A 19
19A
108
M
109
87
107
42A
104
41A 19
19A
109
87
104
42A
41A 19A
19
87
104
42A
41A

CONTINUOUS FORM STATIONERY FOLDING MACHINE WITH PERFORATION ALIGNMENT APPARATUS

This invention relates to improved apparatus for producing continuous form stationery by folding a strip of paper along transverse lines of weakening formed therealong.

More particularly, the invention concerns an improved stationery folding machine of the type having a dispensing roller which directs a continuous strip of paper into a mechanism which distributes successive lines of weakening formed in the paper in substantially opposite directions and having additional mechanisms for creasing the distributed paper along the lines of weakening to produce continuous form stationery.

In another respect, the invention concerns an improved paper folding machine of the type having a dispensing roller, distributing mechanism and accompanying paper folding mechanisms which operate in generally fixed proportional synchronous relationship such that for a given rate of production by the paper folding machine the dispensing roller, distributing mechanisms and accompanying folding mechanisms each have a specific fixed operational speed.

In still a further respect, the invention relates to an improved paper folding machine which has an improved mechanism for adjusting the timing of the distributing unit with respect to the accompanying paper folding mechanisms while maintaining the synchronous relationship thereinbetween.

In yet another respect, the invention relates to an improved timing adjusting apparatus which functions with increased efficiency because of the reduced number of separate adjustments required to operate the apparatus.

The general type of paper folding machine described in U.S. Pat. No. 3,086,768, to Lach, has achieved wide commercial acceptance since it was introduced in the market. While the apparatus described in the Lach Patent has undergone substantial improvements, the basic operational combination still consists of dispensing rollers for supplying a strip of paper to a distributing unit which spreads the paper in a zig-zag fashion and of other moving mechanisms for compressing and generally placing horizontal tension on the paper to form folds along the lines of perforation or weakening formed in the material. During operation of the paper folding machine the distributing unit, dispensing rollers and accompanying paper folding mechanisms operate in general fixed proportional synchronous relationship so that for a given rate of production by the paper folding machine the dispensing rollers, distributing mechanism and accompanying folding mechanisms each have a specific fixed operational speed. The distributing unit, accompanying folding mechanisms and dispensing roller unit are provided with motive power by a common gear train. Before such a paper folding machine is operated, the distributing unit and other mechanisms for folding the paper are adjusted and positioned in relation to the location of the lines of weakening along the strip of material being fed into the machine. In operation, successive lines of weakening must be placed by the distributing unit essentially parallel to and at equal distances to either side of the axis of rotation of the oscillating distributing mechanism. If successive lines of perforation are placed at varying distances to either side of the axis of rotation of the distributing unit, operational efficiency is reduced and the apparatus may not be operated at its optimal speed.

The strip of material or "webbing" fed into the distributing unit is pulled by the dispensing rollers from a large roll of paper mounted to the rear of the paper folding apparatus. Typically, regardless of the care taken by the operator initially setting up the machine, material pulled over the dispensing roller and directed into the distributing unit will not be completely taut when the machine is initially started. This causes successive lines of weakening to be distributed at varying distances from the axis of rotation of the distributing unit, and the operator either has to stop and further adjust the machine or operate the machine at a lower than optimal rate of speed. Apparatus has been developed which allows the timing of the distributing unit and other accompanying paper folding mechanisms to be adjusted while the paper folding machine is being operated. Such apparatus is described in my U.S. Pat. No. 4,522,619.

One kind of continuous form stationery folding machine well known in the art is the "spiral" paper folding machine. Spiral paper folding machines utilize an oscillating chute to distribute successive of weakening formed in paper in substantially opposite directions. Mechanisms called "spirals" and "beaters" receive and fold paper distributed by the chute. The chute, spirals and beaters are synchronized such that for each cycle of movement of the chute, the spirals and beaters rotate one revolution. Consequently, when the chute is at a particular location, it is expected that the spirals and beaters will also be in a designated position. Further, after the oscillating chute has moved to one of its furthest points of travel, has reversed direction, and is moving through its arc of travel toward its other furthest point of travel, the spirals and beaters are timed to engage and crease the paper along a line of weakening distributed by the chute. When the chute, spirals and beaters are synchronized in this fashion, the beaters and spirals engage and crease the paper shortly after a line of weakening is dispensed from the mouth of the chute. I discovered that it is advantageous to slightly advance the timing of the chute with respect to the beaters and spirals. When the timing of the chute is advanced the chute reaches its furthest point of travel, dispenses a line of weakening, and begins moving in the opposite direction (toward its other furthest point of travel) before the spirals and beaters arrive in position to properly contact and crease the paper. When the timing of the chute is advanced in this fashion, the early departure of the chute from its furthest point of travel causes the paper to "snap", facilitating creasing of the paper along the line of weakening.

In conventional spiral folders the chute is carried on a support shaft which is rotatably mounted in the side of the frame of the spiral folder. A fold length bar is attached to the support shaft. A chute crank rod is pivotally bolted to the fold length bar and to a chute swing cam. Consequently, when the cam rotates, the crank rod reciprocates and causes the fold length bar, and therefore the support shaft and chute, to oscillate back and forth. The drive shaft which turns the chute swing cam also provides motive power to the spirals and beaters. The spirals and beaters complete a revolution each time the chute swing cam completes a revolution.

In order to set up the chute to fold a strip of paper along transverse perforations which are equally spaced along the length of paper, one end of the crank rod is pivotally bolted to the swing cam. The other end of the crank rod is pivotally bolted to the fold length bar. The chute support shaft is then loosened from the fold length bar and, along with the chute, is manually moved independently from the fold length bar, crank rod, swing cam, spiral and beaters to center the swing of the chute. The fold length bar is then reconnected to the chute support shaft. The swing cam is turned to reciprocate the crank rod and chute, and the arc of swing of the chute is monitored to insure that the chute moves an equal distance to either side of a vertical line passing through the support shaft. If the chute does not swing equal distances to either side of the chute support shaft, the shaft is again loosened from the fold length bar and the position of the chute support shaft and chute are manually adjusted, etc. This procedure is repeated until the chute moves an equal distance to either side of the vertical axis passing through the chute support shaft.

This prior art adjustment procedure does not, however, permit the timing of the chute to be altered with respect to the spirals and beaters. In fact, as will be described, the prior art adjustment procedure can not be utilized if it is desired to utilize the chute crank rod to advance or retard the timing of the chute in accordance with the invention.

Therefore, it would be highly desirable to provide improvements in paper folding machines of the type described above which would allow precise adjustment of the synchronous timing of the distributing unit with respect to accompanying folding mechanisms.

Accordingly, it is the principal objective of the present invention to provide improved apparatus for folding a strip of paper along transverse lines of weakening formed therealong into a strip of continuous form stationery having zig-zag folds therein.

Another principal objective of the present invention is to provide an improved paper folding machine of the type having a distributing unit for directing successive lines of weakening along a strip of paper in substantially opposite directions for folding by accompanying paper folding mechanisms and having a dispensing roller unit for providing the distributing unit with a continuous strip of paper.

Still another objective of the invention is to provide an improved paper folding machine of the type described having an improved mechanism for adjusting the timing of the distributing unit with respect to the accompanying paper folding mechanisms.

Another objective of the instant invention is to provide an improved paper folding machine of the type described having an improved mechanism for adjusting the timing of the paper distributing unit and accompanying paper folding mechanisms without disturbing the equal swing of the paper distributing chute to either side of a vertical centerline passing through the shaft about which the chute oscillates.

These and other and further more specific objectives and advantages of the invention will be apparent to those skilled in the art from the following detailed description and the drawings. For the purpose of illustrating the invention, the detailed description set forth below and the drawings depict the invention as employed in a specific type of paper folding machine, a "spiral" paper folding machine. However, as will be apparent to those skilled in the art, the improved timing adjustment apparatus described below as being included in the spiral paper folder will be similarly applicable in any other type of paper folding machine wherein a portion of a gear train including a drive shaft actuates paper folding and chute mechanisms which must be synchronized with one another and with dispensing rollers which provide a continuous strip of paper to the paper folding and distributing mechanisms.

FIG. 1 is a perspective view of spiral paper folding machine;

FIG. 1*a* is a view of a paper conveying guide;

Figure 13:
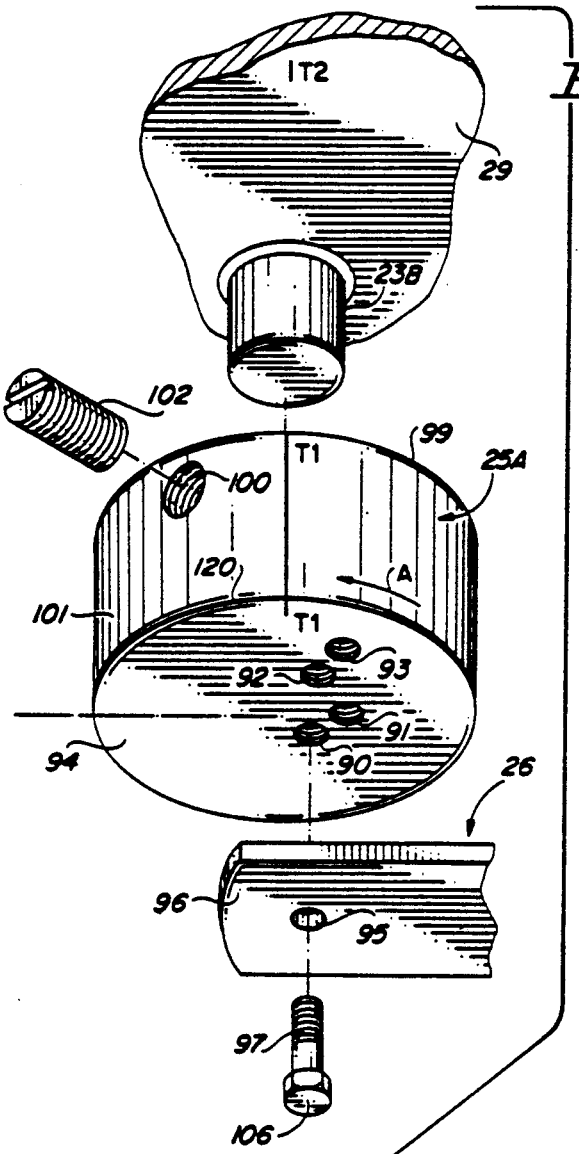
Figure 14:
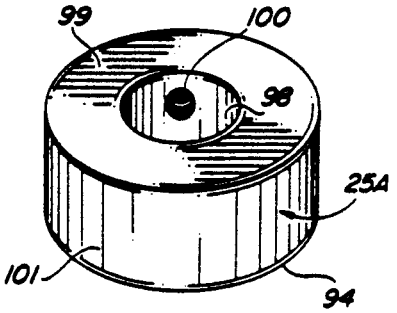
Figure 15:
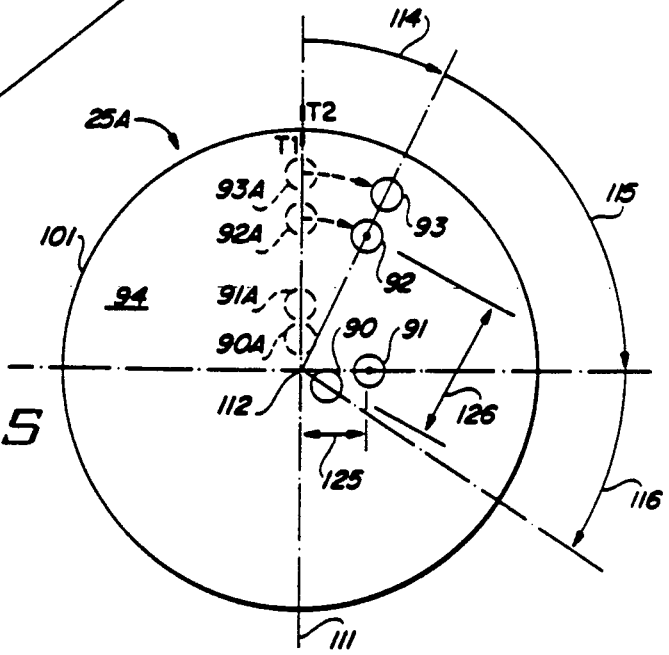

FIG. 12*a*–12*e* are a schematic inter-synchronous relationship of the chute, spirals and beaters during operation of the spiral paper folding machine, and illustrating how the timing adjustment apparatus of the invention alters the timing of the chute with respect to the spirals and beaters;

FIG. 13 is a perspective assembly view illustrating the chute adjustment apparatus of the invention;

FIG. 14 is a perspective view further illustrating chute swing cam of FIG. 13; and, FIG. 15 is a front view further illustrating the chute swing cam of FIG. 14.

Briefly, in accordance with the presently preferred embodiment of my invention, I provide improved apparatus for producing continuous form stationery by folding a strip of paper along transverse lines of weakening formed therein. The apparatus includes a frame; an oscillating chute mounted on a support shaft rotatably journalled in the frame for alternately distributing the successive lines of weakening in the paper in substantially opposite directions, the support shaft including a first outer end, the chute oscillating, between first and second furthest points of travel and traveling an equal distance to either side of the support shaft; rollers carried on the frame for dispensing the continuous strip of paper into the oscillating chute; and, folding means carried on the frame and operatively associated with the oscillating chute for urging the paper distributed by the chute into a folded condition. The folding means includes spirals shaped and dimensioned to receive and carry away from the oscillating chute creased edges of paper distributed by the chute, the spirals being independently adjustable prior to the operation of the apparatus; and, beaters for periodically tamping the paper distributed by the chute, the beaters assisting in the folding and positioning of the paper and being independently adjustable prior to the operation of the apparatus. The spirals and beaters move in sychronous relationship with the chute during the operation of the apparatus. The beaters and spirals each complete a single revolution each time the chute moves from one of the furthest points of travel to the other of the furthest points of travel and returns to said one of the furthest points of travel. The apparatus also includes a support surface for receiving paper dispensed by the spirals and beaters; paper stops positioned above the support surface, each of the paper stops having at least one upstanding face for stopping the lateral travel of creased edges of paper distributed by the chute; and, gear train means for transmitting motive power to the rollers, oscillating chute, and folding means such that generally synchronized movement thereinbetween is maintained; and, power means to drive said gear train means. The apparatus also includes means for simultaneously adjusting the length of the arc of swing of the chute and the timing of the chute in relation to the folding means. The adjustment means includes at least one rotary drive shaft positioned along said gear train means and transmitting motive power to the portion of the gear train means and transmitting motive power to the portion of the gear train means actuating the oscillating chute and the folding means, the drive shaft having a first end; a cam mounted on the first end of the drive shaft and having at least three non-colinear spaced apart attachment points, the cam being rotated by the drive shaft about the axis of the drive shaft; a fold length bar attached to the outer end of the support shaft; a crank rod having a first end pivotally fixedly attached to the fold length bar and having a second end; a first timing point on the frame; a second timing point on the cam, the beaters and spirals each being in a selected reference orientation when the first and second timing marks align; and, means for pivotally removably attaching the second end of the crank rod to any selected one of the attachment points. The axis of the drive shaft and the first and second timing marks lie in a common reference plane when the timing marks are aligned. Each of the plurality of attachment points, when the second end of the rod is pivotally connected thereto with the attaching means, is a radial distance from the axis to cause the chute to oscillate through an arc having a selected length to fold the strip of paper into segments having a selected length, the radial distance and the length of the arc differing for each of the attachment points; maintains the equal distance of travel of the chute to either side of the support shaft; and, maintains the synchronous rate of oscillation of the chute with respect to the rate of rotation of the spirals and beaters.

Turning now to the drawings, which depict the presently preferred embodiment of the invention for the purpose of illustrating the practice thereof and not by way of limitation of the scope of the invention and in which like reference characters identify corresponding parts in the several views, FIGS. 1–7, 9 illustrate the general arrangement of the elements in a conventional spiral folding machine. A frame consisting of horizontal members 11 and vertical members 12 supports conveyor table 13 and various paper folding mechanisms which will be subsequently described. If desired, the frame 11–12 may be further provided with suitable support legs 14 and associated horizontal members 15 mounted on casters 16 to raise the entire apparatus to a convenient working height and to provide for moving the machine within a work area.

A continuous strip of paper or other material is drawn by dispensing roller 17 beneath roller guides 18 and directed into chute 19. dispensing roller 17 is carried on axle 71*a* (not visible in FIG. 1) journalled for rotation in panels 29 and 30. The axle is rotated by the gear train of the apparatus. Roller guides 18 are secured to rod 20 by sleeves 21 provided with axles 22.

A pair of drive shafts 23*a* and 23*b* are integrated with the differential mechanism which is generally indicated by reference character 24. Shaft 23*b* rotates gear 25 in the direction of arrow A causing link 26 to reciprocate arm 27 in the directions of arrows B. Arm 27 is fixedly secured to shaft 28 which is attached to chute 19 and journalled for rotation in panel 30.

Transverse lines of weakening along material entering chute 19 are distributed in substantially opposite directions as chute 19 oscillates and, as later described, the material is compressed and folded by "beaters" and "spirals" (not visible in FIG. 1). Continuous moving belts 32 carried by roller 33 carry the folded paper away from the folding mechanisms in the direction of arrow C. The slope of the conveyor table 13 is adjusted by turning handle 34.

Threaded shafts 38*a* and 38*b* each carry a sprocket 37 which engages continuous chain 36. By turning handle 35 shaft 38*a* is rotated causing the teeth of sprocket 37 to engage and turn continuous chain 36 so that sprocket 37 and shaft 38*b* simultaneously rotate. Rotation of shafts 38*a* and 38*b* horizontally adjusts the positions of the beaters, spirals and paper stops (not visible).

Differential mechanism 24 includes handle 40 for rotating shaft 41 which is provided with worm gear 41*a* engaging ring gear 42 fixedly attached to spider 43. As would be apparent to those skilled in the art, handle 40 may be turned while drive shafts 23*a* and 23*b* are rotated or are motionless so that the position of a particular point on shaft 23*b* may be rotated in relation to a point on shaft 23*b*. When handle 40 is not used to adjust the relative position of shafts 23*a* and 23*b*, the differential functions as an idler, allowing each shaft to turn at identical rpm.

Figure 2:
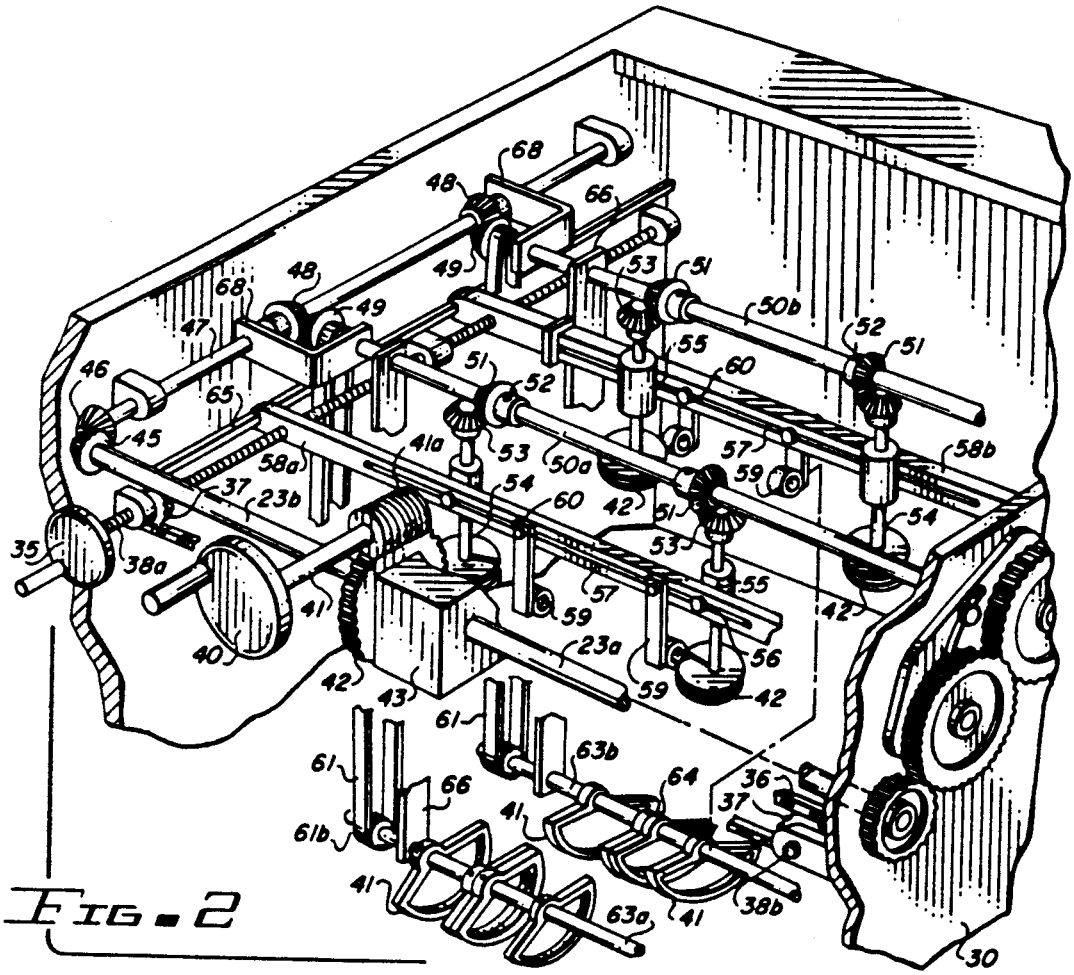
FIG. 2 is an enlarged partial perspective view of the improved spiral paper folding machine of FIG. 1 illustrating details of the paper folding mechanism and associated drive train.

FIGS. 2–7 illustrate the interrelation of the beaters 41, spirals 42, chute 19 and gear train of the apparatus. As shown in FIG. 2, drive shaft 23*b* is provided with pinion gear 45 which drives gear 46 to rotate shaft 47 and bevel gears 49 to rotate shafts 50 and gears 51 which are secured to shaft 50 by setscrews 52. Pinion gears 51 turns beveled gears 53 to rotate shafts 54 and spirals 42. Shafts 54 are journalled for rotation in sleeves 55 which are provided with set screws 56 for transversely adjusting the position of spirals 42 along slots 57 in support bars 58. Paper stops 59 are also fixedly adjustably attached to bars 58 by set screws 60.

When shafts 50 are rotated, continuous belts 61 mounted on rollers 61*a* and 61*b* affixed to rods 50 and 63 turn and simultaneously rotate shafts 61 on which beaters 41 are adjustably mounted. Set screws 64 permit beaters 41 to be positioned along shafts 63.

When threaded shafts 38*a* and 38*b* are rotated by turning handle 35, support bars are moved along rails 65 horizontally positioned on the interior of panels 29 and 30. Member 66 interconnects the left hand (and right hand) ends of shaft 50*a*, bar 58*a* and rod 63*a* so that when threaded rods 38*a* and 38*b* are rotated shaft 50*a*, bar 50*a* and rod 63*a* move in unison. An identical member 66 (not visible) interconnects the right hand (and left hand) ends of shaft 50*b*, bar 50*b* and rod 63*b*. When the position of bars 58*a* and 58*b* are adjusted along threaded rods 38*a* and 38*b* gears 48 slide along rod 47. L-shaped brackets 68 function to keep pinion gears 48 meshed with gears 49.

Figure 3:
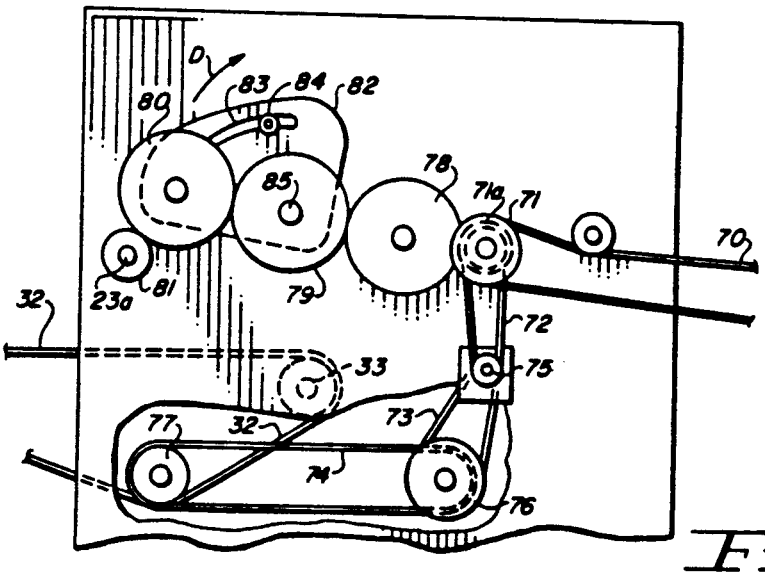
FIG. 3 is a schematic drawing of the right hand side of the paper folding machine of FIG. 1 illustrating the drive mechanism which activates the paper dispensing roller and further transmits motive power to that portion of the gear train activating the paper folding and distributing mechanisms.
Figure 4:
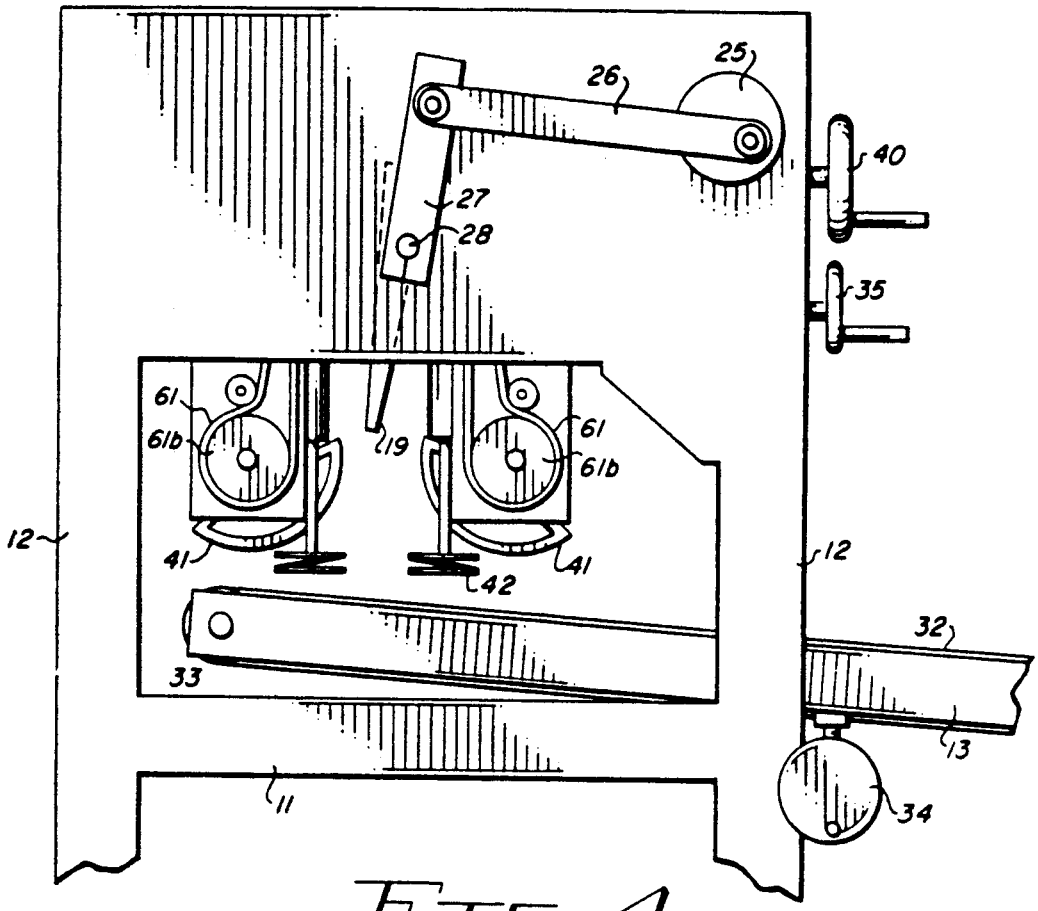
FIG. 4 is a left side elevational view of the improved spiral paper folder of FIG. 1.

As shown in FIG. 3 belt 70 from power means (not shown) which drive the gear train actuates gear 71. Continuous belts 72, 73 and 74 transmit power to conveyor belts 32 of table 13 through pulley gear 75 and rollers 76, 77. Motive power from gear 71 is transmitted through sector gears 78, 79, and 80 to removable toothed gear 81. Gear 80 is attached to plate 82 having slot 83 formed therein and which is rotatably mounted on rod 85. In order to remove gear 81 from shaft 23*a*, gear 80 is upwardly lifted in the direction of arrow D by loosening set screw 84 in slot 83. Depending on the distance between successive lines of weakening in the paper being folded various sized gears 81 are used to rotate drive shaft 23*a*.

Figure 5:
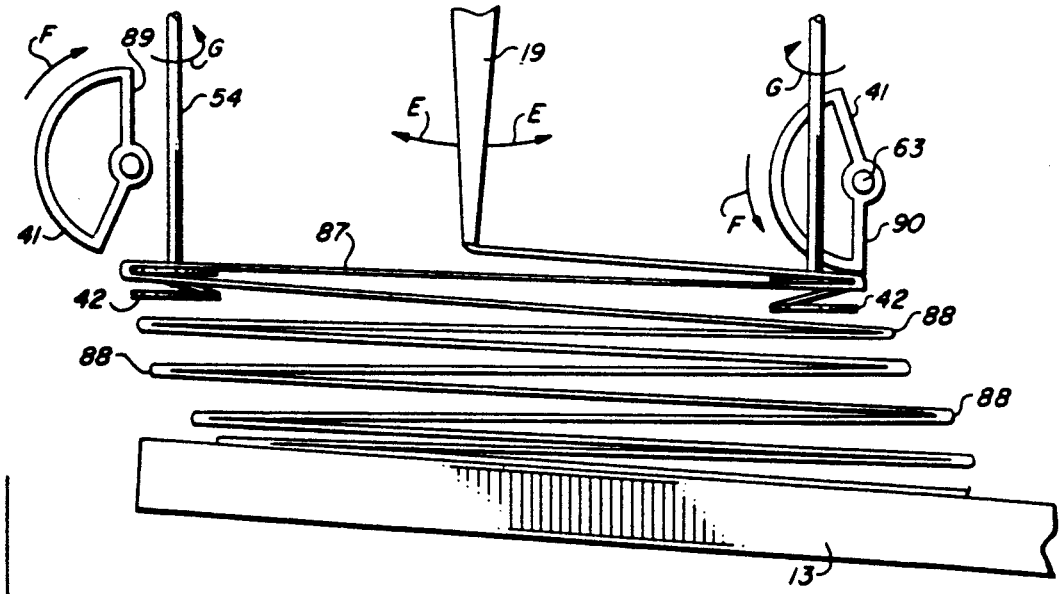
FIG. 5 is a schematic view of the improved spiral paper folder of FIG. 4 showing the interrelationship between the paper folding mechanisms therein.
Figure 6:
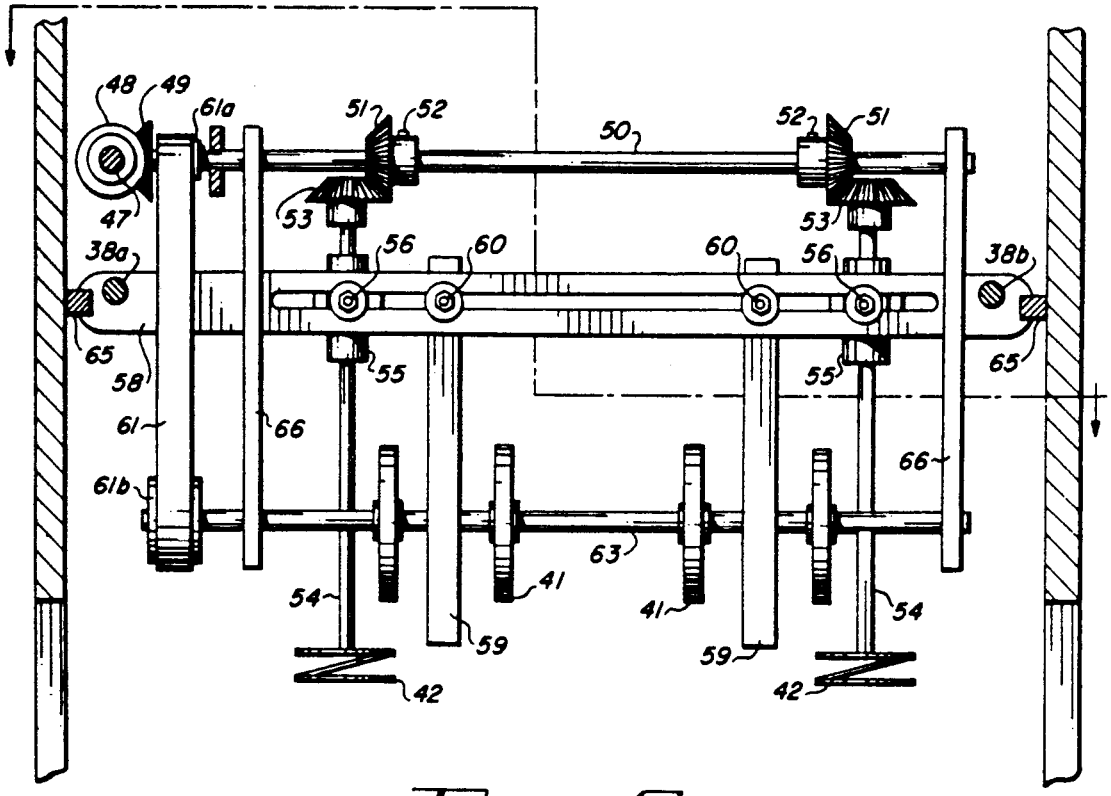
FIG. 6 is a front view of a portion of the spiral paper folding machine of FIG. 1 illustrating further details of the paper folding mechanisms and associated gearing
Figure 7:
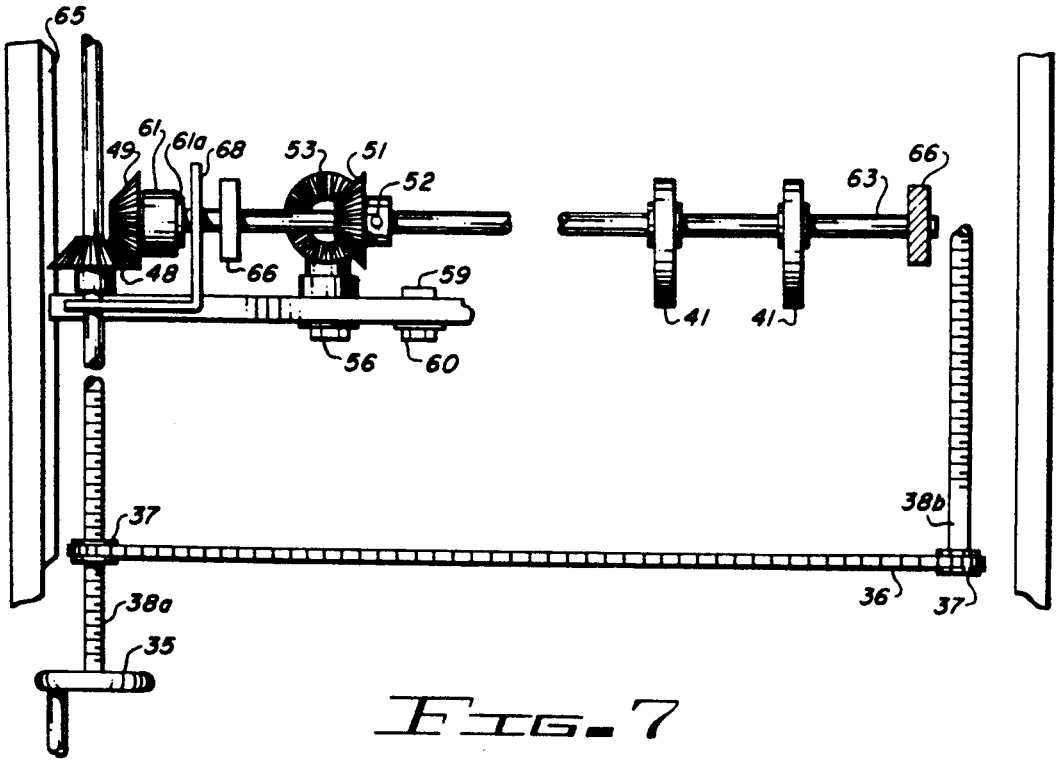
FIG. 7 is a top view of a portion of the spiral paper folder of FIG. 1.

The schematic diagram in FIG. 5 illustrates the synchronous relationship of the chute 19, beaters 41 and spirals 42 as they respectively move in the directions indicated by arrows E, F and G. When lines of weakening formed in the strip of paper are distributed in opposite directions by the chute 19, beaters 41 and spirals 42 compress material 87 to form folds 88. Ideally the beaters 41 strike the upper surface of material 87 one half to two inches behind the lines of weakening along which the paper is folded. The chute and beaters are synchronized such that when the chute is in the middle portion of its oscillation arc, as shown in FIG. 5, the surfaces 90 and 90 of beaters 41 mounted on their respective shafts 63 are in the positions shown in FIG. 5. Similarly when the chute 19 and beaters 41 are in the positions illustrated in FIG. 5 a given point on the periphery of each spirals 42 is in a particular position.

Figure 9:
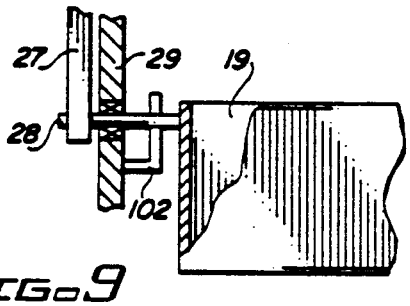
FIG. 9 is a front view of a portion of the spiral paper folding machine illustrating further details of the chute paper distribution mechanism.

As shown in FIG. 9, shaft 28 fixedly attached to chute 19 is journalled for rotation in panel 29 and L-shaped support bracket 102. A sister support bracket 102 provides additional support for shaft 19 as it enters panel 30 on the opposite end of the chute.

In operation, paper is fed into chute 19 at a particular rate by paper dispensing roller 17. As chute 19 distributes successive transverse lines of weakening in opposing directions beaters 41 and spirals 42 function to compress and crease the paper along the lines of weakening. Ideally, the beaters strike the upper surface of the paper being distributed within a range of one-half to two inches behind the lines of weakening or folded edge of the paper or other material. At various operational speeds the operational characteristics of the paper folding mechanisms may vary and the point at which the beaters strike the upper surface of the paper tends to "travel" to a position outside the preferred one-half to two inch range. In particular, at high operational speeds the chute is elastically deformed during its oscillation. This causes the lines of weakening to be distributed off center as previously described. By turning handle 40, shaft 23*b* may be rotated with respect to shaft 23*a* so that the timing of the chute, beaters, and spirals are simultaneously adjusted in relation to the timing of the dispensing roller such that the lines of weakening are again distributed equidistant from the chute axis of rotation. Differential timing mechanism 24 permits this adjustment to be made while maintaining the synchronous relationship of the chute, beaters and spirals.

The exact location of the electric motor or other power means which is used to operate the apparatus described above and the belt 70 (See FIG. 3) or other suitable power transfer means which connect the motor to the operational elements are not shown as so to avoid complication of the drawings. However, as suggested in FIG. 3, the machine motor could be positioned immediately to the rear to the paper folding machine or in a variety of other locations.

While the conventional spiral folder apparatus of FIGS. 1 to 7, 9 does permit the chute, spirals, and beaters to be simultaneously adjusted in relation to the timing of the dispensing roller, the apparatus does not enable the timing of the chute to be adjusted in relation to the beaters and spirals while maintaining the synchronous movement thereinbetween. Such adjustment of the chute is, as will be described, highly desirable. The apparatus of the invention permits such adjustment of the timing of the chute.

FIGS. 13 to 15 illustrate a gear or chute swing cam 25*a* constructed in accordance with the invention and including a plurality of non-colinear attachment points or internally threaded apertures 90 to 93 formed in the face 94 of the cam 25*a*. One end of link or chute crank rod 26 is pivotally removably attached to cam 25*a* by slidably inserting bolt 97 through aperture 95 in one end 96 of rod 26 and then threading bolt 97 into a selected one of the attachment points or apertures 90 to 93. Cylindrical aperture 98 is formed in the rear surface 99 of cam 25*a*. Internally threaded aperture 100 extends from aperture 98 to the outer surface 101 of cam 26*a* in the manner illustrated in FIGS. 13 and 14. Externally threaded set screw 102 is rotated into aperture 100 and against end 23*b* of drive shaft 23 when end 23*b* is slidably inserted in aperture 98. Cam 25*a* is turned by and rotates simultaneously with drive shaft 23 about the longitudinal axis 112 (FIG. 15) of shaft 23 in the direction indicated by arrow A. Each time cam 25 rotates, each spiral 41 and beater 42 complete a full revolution. Consequently, each time a spiral 41 and beater 42 complete a revolution, the chute 19 will move a distance equal to the distance the chute moves when it travels from one of its furthest points of travel to the other of its further points of travel and returns to said one of its furthest points of travel, i.e., each beater and spiral rotates once each time the chute travels a distance equal to two times the length of the arc of swing of the chute.

When end 96 of link or rod 26 is attached to cam 25*a* with bolt 97, aperture 95 can freely slidably pivot or move about the end of bolt 97 near head 106. The other end of rod 26 is pivotally attached to fold length bar or arm 27 in the manner illustrated in FIGS. 1 and 4. During utilization of the apparatus of the invention, the position of the end of rod 26 which is pivotally attached to bar 27 is never altered, i.e., the position of the end of rod 26 along bar 27 is not changed or adjusted. This is important because if the position of attachment of rod 26 to bar 27 is altered, bar 27 must be loosened from chute support shaft 28 and held steady while the position of the chute is manually adjusted to insure that the chute swings an equal distance to either side of shaft 28 during operation of the folding machine.

Fixed timing mark T2 is formed on the panel 29 of the frame of the apparatus. Timing mark T1 is formed on and rotates with cam 25*a*. When end 96 is attached to aperture 93, chute 19 oscillates through an arc 107 (FIG. 12) of sufficient length to fold a strip of paper into a selected length, for example fourteen inches. When end 96 is attached to aperture 92, chute 19 oscillates through an arc 107 having a selected length which is less than the length of the arc 18 when end 26 is attached to aperture 93 and which is of sufficient length to fold a strip of paper into a second selected length, for example eleven inches. When end 96 is attached to aperture 91, chute 19 oscillates through an arc 107 having a selected length which is less than the length of the arc 107 when end 96 is attached to apertures 93 and 92 and which is of sufficient length to fold a strip of paper into a third selected length, for example eight and a half inches. When end 96 is attached to aperture 90, chute 19 oscillates through an arc 107 having a selected length which is less than the length of the arc 17 when end 96 is attached to any one of apertures 91 to 93 and which is of sufficient length to fold a strip of paper into a fourth selected length, for example seven inches.

Figure 8A:
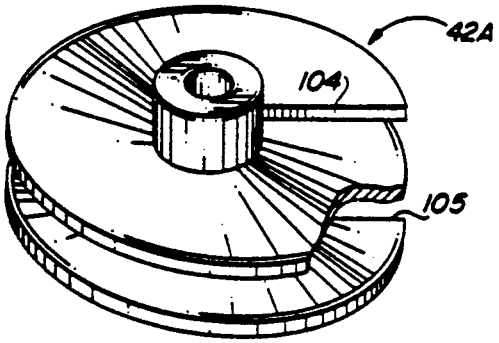
FIG. 8A is a perspective view illustrating a spiral utilized in the apparatus of the invention.
Figure 8B:
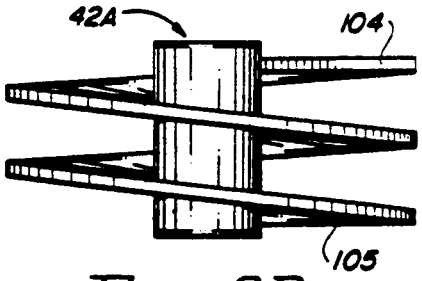
FIG. 8B is a side view further illustrating the spiral of FIG. 8A.
Figure 10:
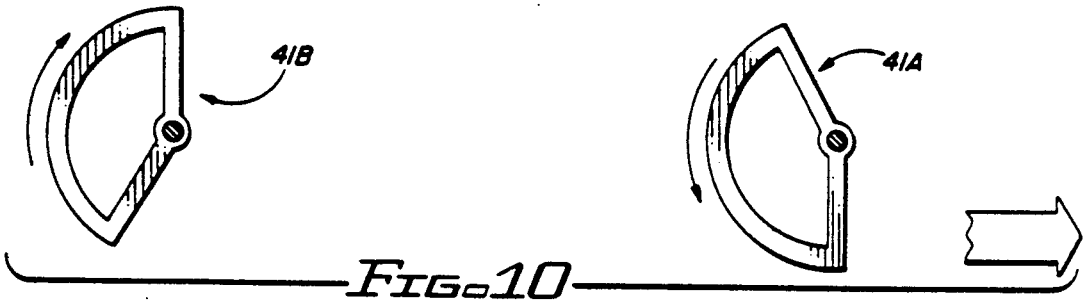
FIG. 10 is a side view of the front and rear beaters of the spiral paper folding machine illustrating the orientation of the beaters when timing marks on the chute swing cam and frame of the machine are aligned.
Figure 11:
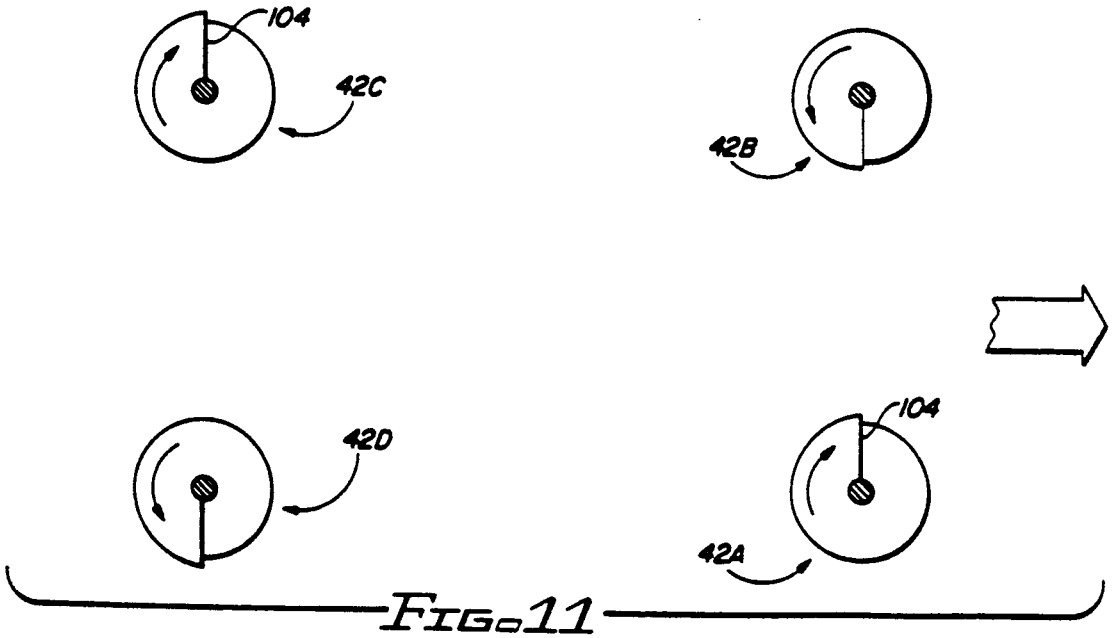
FIG. 11 is a top view of the front and rear spirals of the spiral paper folding machine illustrating the orientation of the spirals when timing marks on the chute swing cam and frame of the machine are aligned.

When timing marks or points T1 and T2 are aligned, the beaters 41 and spirals 42 are positioned with respect to one another in the manner illustrated in FIGS. 10 and 11. In FIG. 10 beater 41*a* is one of the beaters on rod 63*a* in FIG. 2 while beater 41*b* is one of the beaters on rod 63*b* in FIG. 2. Also, beater 41*a* corresponds to the right hand beater in FIG. 5; beater 41*b* corresponds to the left hand beater in FIG. 5. n FIG. 11, spiral 42*a* corresponds to the left hand spiral driven by rod 50*a* in FIG. 2; spiral 42*b* correspond to the right hand spiral driven by rod 50*a*; spiral 42*d* corresponds to the left hand spiral driven by rod 50*b*; and, spiral 42*c* corresponds to the right hand spiral driven by rod 50*b* in FIG. 2. Spirals 42*a* and 42*c* are "left handed" spirals like the spiral 42 illustrated in FIG. 8*a*. Spirals 42*d* and 42*b* are "right handed" spirals.

When the beaters and spirals are in the reference orientation position illustrated in FIGS. 10 and 11 and the timing marks T1 and T2 are aligned, the chute 19 is in a selected orientation position with respect to the spirals and beaters. The ideal position of the chute with respect to a particular reference orientation position of the beaters and spirals varies with the length of fold produced by the apparatus of the invention. When the beaters and spirals are in the position illustrated in FIGS. 10 and 11, beaters 41*a* and spirals 42*a* and 42*b* have normally engaged or "grabbed" and folded a line of weakening and the chute is at a point intermediate the two farthest points of travel 108 and 109 (FIG. 12) of the chute. The selected orientation position of the chute 19 with respect to a particular reference orientation position of the spirals and beaters is determined by the angle of the attachment point 90 to 93 from a reference plane 111 passing both through the axis 112 about which cam 25*a* rotates and through aligned timing marks T1 and T2. In FIG. 15, plane 111 is perpendicular to the plane of the sheet of paper of the drawing, is perpendicular to face 94, and passes through axis 112 and aligned timing points or marks T1 and T2. Axis 112 is also perpendicular to the plane of the sheet of paper of the drawings in FIG. 15.

In FIG. 15 the angle of aperture 93 from reference plane 111 is indicated by arrow 114. The angle of aperture 91 from plane 111 is indicated by the sum of the angles indicated by arrows 114 and 115, and, the angle of aperture 90 from plane 111 is indicated by the sum of the angles indicated by arrows 114, 115, and 116. The radial distance of aperture 91 from axis 112 is indicated by arrow 125. Arrow 126 indicates the radial distance of aperture 92 from axis 112.

If apertures 90 to 93 are colinear in the manner indicated by dashed apertures 90*a* to 93*a*, then moving the attachment of end 96 from one aperture or point 90 to 93 to another point 90 to 93 only adjusts the length of swing of chute 19 and does not advance or retard movement of the chute with respect to the spirals and beaters. The effect of moving apertures 90 to 93 through a selected angle 114, 115, 116 from reference plane 111 is further explained with reference to FIGS. 12*a* to 12*e*. In each of FIGS. 12*a* to 12*e*, the position of the chute 19 and of a selected spiral 42*a* and beater 41*a* at a particular instant is pictured to illustrate the synchronous relation therebetween. Since each beater and spiral completes a revolution whenever the chute completes two swings through its arc 107, the position of the other beaters and spirals not shown in FIGS. 12*a* to 12*e* can be readily determined with reference to FIGS. 10 and 11. At its farthest points of travel 108, 109 the mouth of the chute normally points at either the rear spirals 42*a*, 42*b* or the front spirals 42*c* and 42*d*, respectively. As is illustrated in FIGS. 12A to 12E chute 19 is in a selected orientation position whenever the spirals and beaters are in a particular reference orientation position. When the spiral 42*a* and beater 14 are in the reference orientation position shown in FIG. 12A, the chute is in a corresponding selected orientation position in the middle portion of the swing of chute 19 through its arc 107 in the direction of arrow L. When the spiral 42*a* and beater 41*a* are in the reference orientation position shown in FIG. 12B, the chute 19 is at one of the furthest points 108 of its travel and the mouth of chute 19 points toward spirals 42*c* and 42*d*. When the spiral 42*a* and beater 41*a* are in the reference orientation position shown in FIG. 12C, the chute 19 is again in the middle portion of its arc of swing 107 and is moving in the direction of arrow M. When the spiral 42*a* and beater 41*a* are in the reference orientation position illustrated in FIG. 12D, the chute is in a selected orientation position corresponding to its furthest point of travel 109 toward spirals 42*a* and 42*b* (FIG. 11) and is beginning to reverse direction to move in the direction of arrow L. When the spiral 42*a* and beater 41*a* are in the reference orientation position illustrated in FIG. 12E, the chute 19 is in a selected orientation position in the middle of its arc of swing 107 and is moving in the direction of arrow L away from spiral 42*a* and toward spirals 42*d* and 42*c*. Spiral 42*a* and beater 41*a* are in the orientation shown in FIGS. 12A and 12E when the timing marks T1 and T2 align.

Figures 12A, 12B, 12C, 12D, 12E:
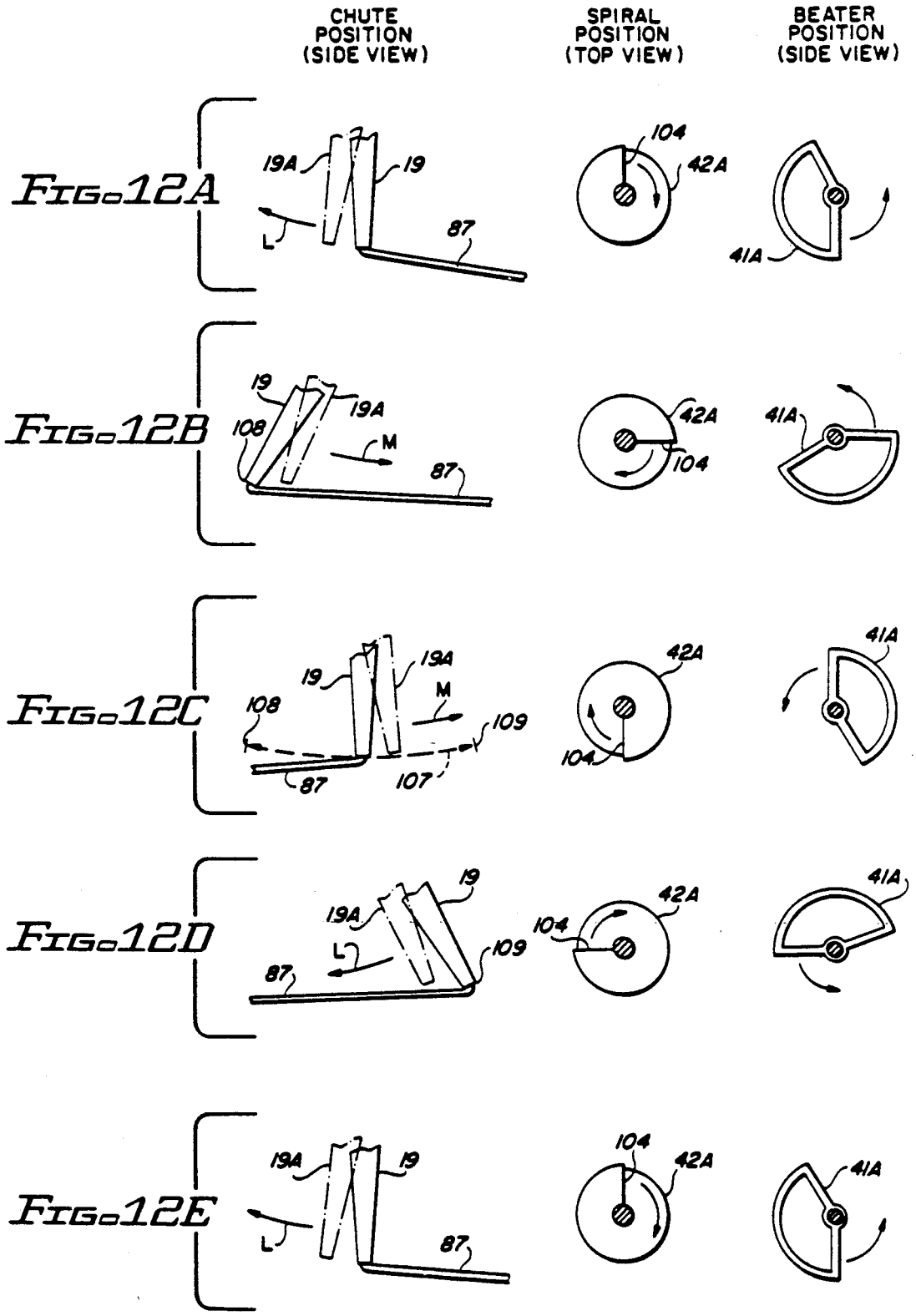

The effect of moving an attachment aperture 93 through an angle 114 on cam 25*a* is illustrated in FIG. 12. If end 96 is connected to an attachment aperture 93*a* when the chute 19 oscillates in the manner illustrated in FIGS. 12A to 12E, then removing the bolt attaching end 96 to aperture 93*a* and reattaching end 96 to aperture 93 would tend to advance the timing or movement of chute 19 in the manner indicated by dashed lines 19A. Consequently, when end 96 is attached to aperture 93 the synchronous rate of movement of the chute, spirals, and beaters remains the same and the position of the chute 19A for any given reference orientation position of the spiral 42*a* and beater 41*a* is "ahead" of the position of the chute 19 when end 96 is connected to attachment aperture 93*a*. Dashed lines 19*a* indicate the positions of the chute when end 96 is attached to aperture 93. Solid chute lines 19 indicate the position of the chute when end 96 is attached to aperture 93*a*. During synchronous movement of the chute, spirals and beaters, the spirals and beaters each turn a single revolution each time the chute 19 travels a distance equal to twice the length of the arc of swing 107 of the chute 19 between the furthest points of travel 108 and 109.

If the adjustment points are colinear in the manner indicated by dashed circles 90*a* and 93*a*, adjusting the chute crank rod 26 by moving end 96 from one attachment point 90*a*–93*a* to another different attachment point 90*a*–93*a* only alters the length of the arc of swing 107 of chute 19 and does not advance or retard the selected orientation position of chute 19 with respect to a reference orientation position of spiral 42*a* and beater 41*a*.

In sum, for the apparatus of the invention to function properly, the point at which the chute crank rod 26 is attached to the fold length bar 27 must remain fixed, adjustment points 90 to 93 can not be colinear, and each attachment point 90 to 93 must be positioned a selected angle from a reference plane 111. The reference plane 111 that is selected need only pass through axis 112 and a point on the peripheral edge 120 of cam 25*a*. The reference plane 111 enables a particular reference orientation of the spirals and beaters to be identified when the cam 25*a* is at a particular orientation of the beaters and spirals for a particular position of the cam 25*a* is identified, the selected orientation of the chute 19 can be selected as desired and an attachment aperture 90–93 appropriately positioned on cam 25*a*.

Figure 1:
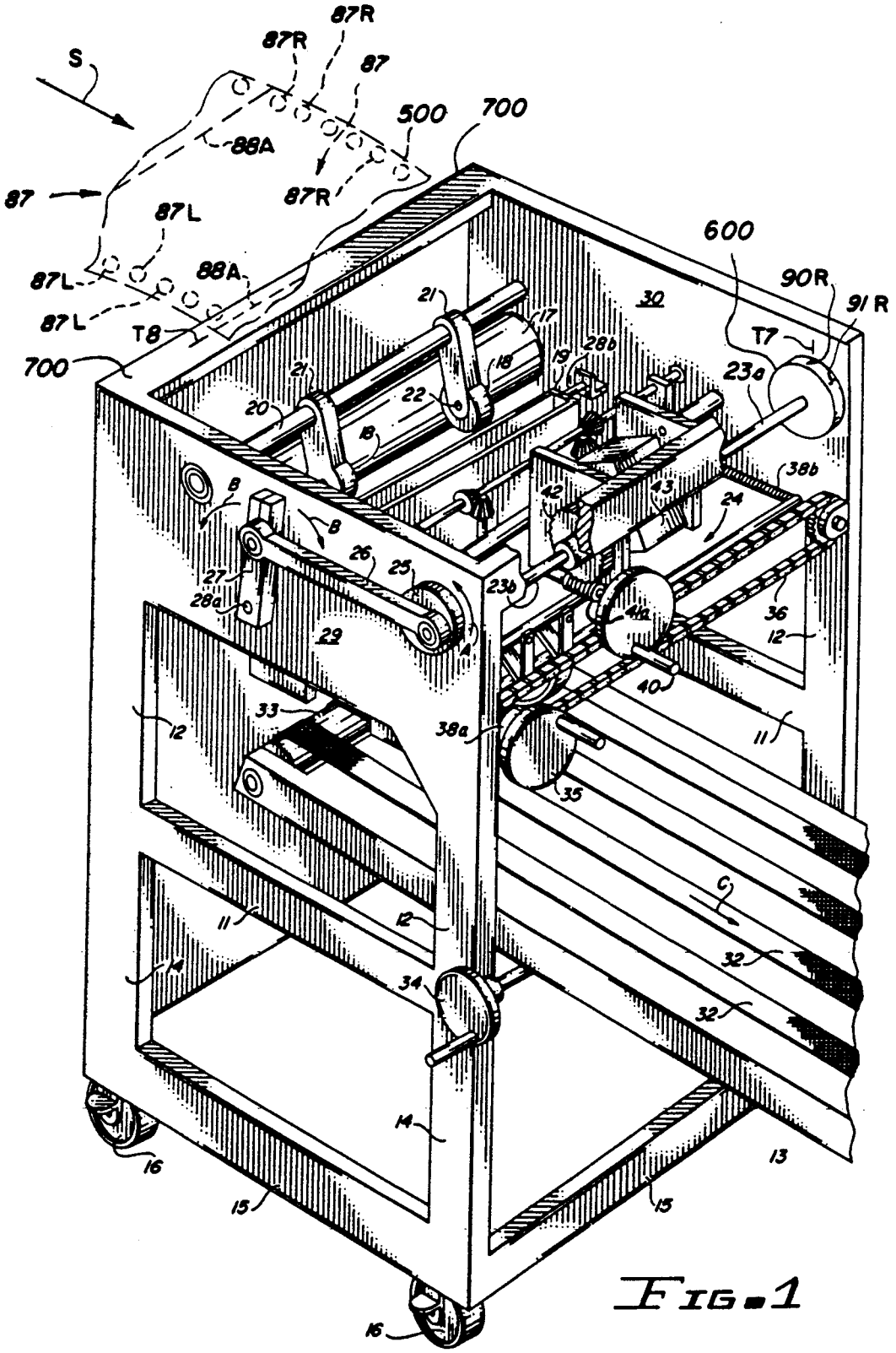

In FIG. 1, reference disk 600 is fixedly attached to and rotates with rod 23*b*. Timing or positioning mark T8 is inscribed on the frame at a point over which strip of paper 87 passes as the paper is drawn by feed roller 17 into chute 19. Indicator means or disk 600 has reference lines 91R and 90R inscribed on the periphery thereof. Timing or positioning mark T7 is inscribed on the panel 30 of the frame. Reference line 90R is utilized when bolt 97 (FIG. 13) is in aperture 90. Reference line 91R is utilized when bolt 97 is in aperture 91 (FIG. 13). Other reference lines can be formed on disk 600 for when bolt 97 is in apertures 92 or 93.

Mark T8 and disk 600 can be used to properly position transverse perforations in a paper strip 87 passing through the folding machine of FIG. 1. Bolt 97 (FIG. 13) is utilized to secure end 96 of rod 26 to a selected one of attachment apertures 90 to 93. In FIG. 1, bolt 97 secures end 96 to aperture 90. When end 26 is secured to aperture 90 and disk 600 is at a certain position, then chute 19 is at a known position in its arc of travel and the distance of travel of a perforation 88A from mark T8 to the dispensing mouth of chute 19 is readily determined, and, when disk 600 is at a certain point and a line of perforation 88A is aligned with mark T8, then the perforation being dispensed by chute 19 is at the desired position with respect to the mouth of the chute. Accordingly, in the invention, timing mark T8, disk 600, and mark T7 enable the position of a line of weakening 88A to be properly adjusted by synchronously moving the spirals, beaters, chute, and rod 23*b* until disk 600 is positioned so the proper reference mark 91R or 90R aligns with mark T7; by stopping movement of the spirals, beaters, chute, and rod 23*b*; and by then directing strip of paper 87 into and through chute 19 (which is, along with the spirals and beaters, stationery) until a line of perforation 88A corresponds to and is aligned with timing mark T8. Synchronous operation of the spirals, beaters, chute and rod 23*b* is then resumed. In FIG. 1, timing mark T8 is adjacent or aligned with a line of perforation 88A, and mark 90R is aligned with mark T7.

If end 96 is secured to gear 25 by bolt 97 being turned into aperture 90, then a line of perforation 88A should align with timing mark T8 when reference line 90R aligns with timing mark T7. The position of paper being fed into the paper folding machine of FIG. 1 is adjusted by first synchronously moving the spirals, beaters, chute, and rod 23*b* until disk 600 is positioned so reference mark 90R aligns with timing mark T7. When the motor supplying motive power to the machine of FIG. 1 is turned off, disk 600 can be manually rotated to synchronously move the spirals 42, beaters 41, chute 19 and rod 23*b*. After mark T7 is aligned with reference line 90R, strip of paper 87 is manually pulled intermediate roller 17 and roller guides 18 through chute 19 until a line of weakening or of perforation 88A is aligned with timing mark T8. In FIG. 1, a line of perforation 88A is aligned with timing mark T8. Mark T8 is immediately adjacent and at one end of the line of perforation 88A aligned with mark T8. Aligning a line of perforation 88A with timing mark T8 means that when normal motorized operation of the machine of FIG. 1 is resumed, lines of weakening will generally be dispensed from the mouth (i.e., the lower end) of chute 19 when the chute is in desired locations in its arc of travel. A line of weakening is usually dispensed when the chute is at or near one of the furthest points 108, 109 of its travel (FIG. 12) During normal motorized operation of the machine of FIG. 1, the spirals 42, beaters 41, chute 19 and rod 23*b* synchronously operate. When paper 87 is pulled through chute 19 to align a line of perforation 88A with mark T8, enough paper is usually pulled through chute 19 so the paper can be threaded into spirals 42.

When bolt 97 secures end 96 to aperture 91 of gear 25, then reference line 91R of disk 600 is aligned with mark T7 before strip of paper 87 is pulled intermediate roller 17 and guides 18 and through chute 19 to align a line of perforation 88A with timing mark T8.

Figure 1A:
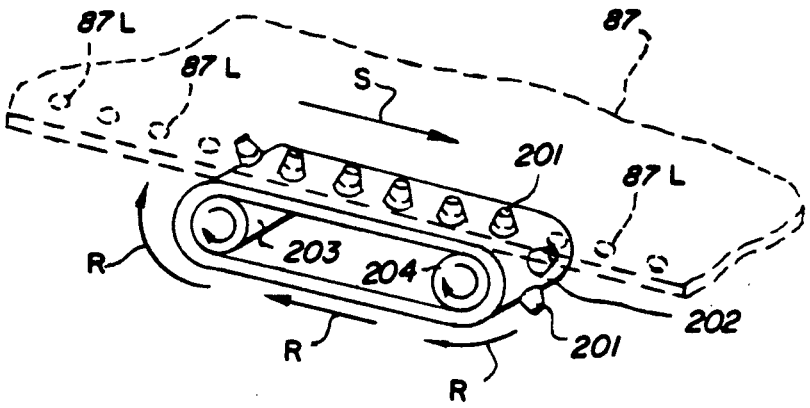

Equally spaced apertures 87L are formed along one edge of strip 87. Equally spaced apertures 87R are formed along the other edge of strip 87. Paper 87 passes over upper planer surface 700 before traveling intermediate roller 17 and guides 18. If desired, aperture guides can be affixed to surface 700. One such guide is illustrated in FIG. 1A and includes teeth 201 which are carried on a continuous belt 202. The belt 202, and teeth on the belt, rotate about rollers 203, 204 in the direction of arrows R to engage apertures 87L and pull them in the direction of arrow S. The teeth 201 engage apertures 87L. The aperture guide functions to control and stabilize movement of paper 87 by preventing lateral movement of paper 87. If desired, timing mark T8 can be formed on a stationary portion of the aperture guide. The aperture guide of FIG. 1A includes a housing (not shown) which is fixedly attached to frame 700 and rotatably carries rollers 203, 204. Timing mark T8 can be formed on this fixed housing. Motive power means can be connected to roller 203 and/or 204 to turn the same. Alternatively, the motive power means which is independent of the aperture guide of FIG. 1A and which turns roller 17 can indirectly rotate rollers 123 and 203 and 204 when apertures 87L engage and "pull" teeth 201 in the direction of arrow S. Roller guides of the type illustrated in FIG. 1A are well known in the art.

A principal advantage of utilizing timing marks T7 and T8 and disk 600 to align a line of perforation 88A to properly position strip of paper 87 in the machine of FIG. 1 is that the utilization timing marks T7 and T8, along with reference lines formed on disk 600 is normally quickly understood by individuals having little mechanical aptitude or understanding of the functions of spiral paper folding machines.

Marks T7, T8, 90R, 91R can be inscribed, printed, comprise raised portions, or otherwise formed, affixed, etc. The indicator means can, instead of comprising disk 600, comprise any other structure attached to or integrated with shaft 23*a*. Disk 600 can, for instance, be eliminated and marks 90R and 91R formed on shaft 23*a*

Having described my invention in such terms as to enable those skilled in the art to understand and practice it, and having identified the presently preferred embodiments thereof, I claim:

1. In combination with apparatus for producing continuous form stationery by folding a strip of paper along transverse lines of weakening formed therein, said apparatus including a frame, oscillating guide means mounted on said frame for alternately distributing said successive lines of weakening in said paper in substantially opposite directions, means for feeding said paper into said guide means at a predetermined speed, folding means carried on said frame and operatively associated with said oscillating guide means for urging said paper distributed by said guide means into a folded condition, said folding means including first and second spaced apart sets of spirals shaped and dimensioned and rotatably driven to receive paper from said oscillating guide means to fold the paper along the transverse lines of weakening, gear train means for transmitting motive power to said oscillating guide means, feeding means, and folding means such that generally synchronized movement thereinbetween is maintained, power means to drive said gear train means, the improvement comprising means for positioning said strip of paper in said apparatus such that a line of weakening is distributed by said guide means when said guide means is in a selected operative position, said positioning means including:

(a) a first fixed positioning mark on said apparatus adjacent said strip of paper moving through said apparatus;

(b) a second fixed positioning mark on said apparatus adjacent a portion of said gear train means;

(c) a rotating shaft in said gear train means and having a portion adjacent said second fixed position mark; and, (d) indicator means on said rotating shaft, said indicator means rotating simultaneously with said shaft during operation of said apparatus and including a reference mark;

said indicator means being positioned on said rotating shaft such that when said reference mark is aligned with said second mark one of said lines of weakening is adjacent said first positioning mark.

* * * * *